US009545157B2

(12) United States Patent
Smith

(10) Patent No.: US 9,545,157 B2
(45) Date of Patent: Jan. 17, 2017

(54) MATTRESS FOR USE DURING PREGNANCY

(71) Applicant: Felicia Smith, Knightdale, NC (US)

(72) Inventor: Felicia Smith, Knightdale, NC (US)

( * ) Notice: Subject to any disclaimer, the term of this patent is extended or adjusted under 35 U.S.C. 154(b) by 0 days.

(21) Appl. No.: 14/575,693

(22) Filed: Dec. 18, 2014

(65) Prior Publication Data

US 2016/0174726 A1 Jun. 23, 2016

(51) Int. Cl.

| | |
|---|---|
| ***A47C 20/00*** | (2006.01) |
| ***A47C 20/02*** | (2006.01) |
| ***A47C 27/14*** | (2006.01) |
| ***A47C 27/18*** | (2006.01) |

(52) U.S. Cl.

CPC ..... *A47C 27/146* (2013.01); *A47C 20/025* (2013.01); *A47C 27/18* (2013.01); *A47C 20/026* (2013.01); *Y10S 5/93* (2013.01)

(58) Field of Classification Search

CPC . A47C 20/025; A47C 20/026; A61G 2200/12; Y10S 5/93

USPC ..... 5/735, 731, 722, 631, 632, 630, 930

See application file for complete search history.

(56) References Cited

U.S. PATENT DOCUMENTS 3,118,152 A * 1/1964 Talley, Jr. ..... A47C 20/025 5/631
3,378,862 A * 4/1968 Skinner ..... A47C 20/025 5/722
3,988,793 A * 11/1976 Abitbol ..... A47C 20/025 5/735
4,021,872 A * 5/1977 Powell ..... A47C 20/025 5/722
4,737,999 A * 4/1988 Halverson ..... A47C 20/025 5/710
4,819,287 A * 4/1989 Halverson ..... A47C 20/025 5/631
5,185,897 A * 2/1993 Van Laanen ..... A47C 20/025 5/631
5,237,712 A * 8/1993 Ramsay ..... A47C 20/025 5/710
5,369,824 A * 12/1994 Powell ..... A47C 20/025 5/735
5,400,449 A * 3/1995 Satto ..... A47C 20/021 5/631
5,412,824 A * 5/1995 Emerson ..... A47C 20/025 5/631
5,425,147 A * 6/1995 Supplee ..... A47C 20/025 5/713
5,679,040 A * 10/1997 Bianchi-Holm ..... A47C 20/00 441/129
D392,145 S * 3/1998 Thurston ..... 5/735
(Continued)

FOREIGN PATENT DOCUMENTS

FR 2687294 A1 * 8/1993 ..... A47C 20/025

*Primary Examiner* — Robert G Santos

(57) ABSTRACT

A mattress and method of manufacturing the same are provided that may be used during pregnancy. In particular, a mattress and method of manufacturing the same are provided that include a main body portion. The main body portion may define a top surface, bottom surface, first side surface, second side surface, foot surface, and head surface. The mattress may further define a cutout formed in the top surface. At least one insert may be provided that may be disposed in the cutout of the main body portion, with the at least one insert including a substantially concave surface that may receive a user's stomach.

16 Claims, 7 Drawing Sheets

(56) References Cited

U.S. PATENT DOCUMENTS

| | | | | | |
|---|---|---|---|---|---|
| 5,819,348 | A * | 10/1998 | Ryan | A47C 20/025 | 5/722 |
| D403,194 | S * | 12/1998 | Thurston | 5/735 | |
| 5,890,246 | A * | 4/1999 | Davis | A47C 20/025 | 5/706 |
| D411,933 | S * | 7/1999 | Bernstein | 5/735 | |
| 6,044,505 | A * | 4/2000 | Friedman | A47C 20/025 | 5/631 |
| 6,233,768 | B1 * | 5/2001 | Harding | A47C 20/025 | 5/706 |
| 6,408,470 | B1 * | 6/2002 | Powers | A47C 20/025 | 5/631 |
| 6,581,229 | B2 * | 6/2003 | Bernstein | A47C 20/025 | 5/631 |
| 6,854,144 | B1 * | 2/2005 | Mehring, Jr. | A47C 27/20 | 5/722 |
| 7,065,816 | B2 * | 6/2006 | McGettigan | A47C 20/025 | 5/727 |
| 7,127,764 | B1 * | 10/2006 | Harding | A47C 20/00 | 5/713 |
| 2002/0020022 | A1 * | 2/2002 | Bernstein | A47C 20/025 | 5/722 |
| 2004/0237205 | A1 * | 12/2004 | McGettigan | A47C 20/025 | 5/727 |
| 2016/0174726 | A1 * | 6/2016 | Smith | A47C 27/146 | 5/735 |

* cited by examiner

MATTRESS FOR USE DURING PREGNANCY

FIELD OF THE INVENTION

The present invention relates generally to mattresses for improving the comfort of women during pregnancy.

BACKGROUND

Conventional mattresses are soft, rectangular cushions that may stabilize and support a user's body. Mattresses typically have flat top surfaces on which the user may lie. Users typically sleep in any of a number of positions that they find comfortable. However, pregnant women often have difficulty using these conventional mattresses in the same positions that they previously found comfortable because conventional mattresses are not designed to stabilize and support their changing bodies.

There is a need for a mattress that comfortably supports a pregnant user from conception through the third trimester of her pregnancy to ensure that she can continue to sleep normally. In particular, it is often most difficult for a user to sleep on her stomach during pregnancy. There is also a need for these mattresses to be cost effective and versatile, to allow their seamless use before, during, and after pregnancy.

BRIEF SUMMARY OF EXAMPLE EMBODIMENTS

Mattresses, and corresponding methods of manufacture, are therefore provided for use during pregnancy that include a cutout to allow a user to sleep on her stomach. In some embodiments, a mattress for use during pregnancy may be provided. The mattress may include a main body portion, which comprises a top surface, a bottom surface, a first side surface, a second side surface, a foot surface, a head surface, and a cutout formed in the top surface. The mattress may further comprise at least one insert configured to be disposed in the cutout of the main body portion. The at least one insert may define a substantially concave surface configured to receive a user's stomach.

In some embodiments, the mattress may include a cover surrounding the main body portion. The cover may be configured to maintain the at least one insert in the cutout. The cover may comprise an access opening configured to allow the user to access the at least one insert. The cover may additionally or alternatively be configured to deform along a portion of the cover aligned with the cutout.

In some embodiments, the at least one insert may comprise a first insert and a second insert. The first insert may define a first upper surface and a first lower surface and the second insert may define a second upper surface and a second lower surface. The second insert may be configured to receive the first insert therein and the first lower surface may be configured to be disposed adjacent the second upper surface. The second insert may be configured to be received by the cutout of the main body portion and the second lower surface may be configured to engage the cutout. The first upper surface and a plane of the top surface of the main body portion may be configured to define a first volume and the second upper surface and the plane of the top surface of the main body portion may be configured to define a second volume, such that the second volume may be greater than the first volume.

In some embodiments, the mattress may include a plug insert having an upper surface and a lower surface. The lower surface of the plug insert may be configured to engage the first upper surface; and wherein the upper surface of the plug insert is substantially planar, such that the upper surface of the plug is substantially flush with the top surface of the main body.

In some embodiments, the main body portion of the mattress comprises at least a first layer and a second layer. The first layer of the main body portion may be configured to define the top surface of the main body portion. A first portion of the cutout may be defined in the first layer and a second portion of the cutout may be defined in the second layer. The at least one insert may comprise a first insert and a second insert. In some embodiments, when the first and second inserts are engaged with the cutout, the second insert may engage the first and second layers and the first insert may engage the first later and the second insert.

In some embodiments, the at least one insert may be configured to be replaced with at least one replacement insert. The at least one replacement insert may define a replacement concave surface. The replacement concave surface may have a curvature that is different than the concave surface of the at least one insert.

In some embodiments, the cutout may be defined in the top surface between the first side surface and a centerline extending between the foot surface and the head surface.

The at least one insert may comprise a first insert and a second insert. The first insert may define a great-circle distance between 1.96 and 3.93 inches. In some embodiments, the at least one insert may comprise a second insert, and the second insert may define a great-circle distance between 10.24 and 11.81 inches. The at least one insert may be configured to be removable, such that the cutout defines a great-circle distance between 11.81 and 13.39 inches.

In another embodiment of the present invention, a method of manufacturing a mattress for use during pregnancy is provided. The method may comprise forming a main body portion which includes a top surface, a bottom surface, a first side surface, a second side surface, a foot surface, and a head surface. In some embodiments, the method may also include forming a cutout in the top surface of the main body portion. The method may further include forming at least one insert. The at least one insert may be configured to be disposed in the cutout of the main body portion, wherein the at least one insert defines a substantially concave surface configured to receive a user's stomach.

In some embodiments, forming the at least one insert may comprise cutting material from the cutout of the main body portion substantially simultaneously with forming the cutout. Forming the at least one insert may comprise forming a first insert and a second insert. The first insert may define a first upper surface and a first lower surface and the second insert may define a second upper surface and a second lower surface. The second insert may be configured to receive the first insert therein and the first lower surface may be configured to engage the second upper surface. The second insert may be configured to be received by the cutout of the main body portion and the second lower surface is configured to engage the cutout. The first upper surface and a plane of the top surface of the main body portion may be configured to define a first volume and the second upper surface and the plane of the top surface of the main body portion may be configured to define a second volume, such that the second volume may be greater than the first volume.

Forming the main body portion may comprise disposing at least a first layer on top of a second layer, such that an upper surface of the first layer may define the top surface of the main body portion. Forming a cutout may comprise forming a first portion of the cutout in the first layer and forming a second portion of the cutout in the second layer. Forming the at least one insert may comprise forming a first insert from the first layer and forming a second insert by cutting through the first and second layers.

The method may further comprise forming a plug insert having an upper surface and a lower surface. The lower surface of the plug insert may be configured to engage the first upper surface, and the upper surface of the plug insert may be substantially planar, such that the upper surface of the plug may be substantially flush with the top surface of the main body portion.

BRIEF DESCRIPTION OF THE DRAWINGS

Figure 1:
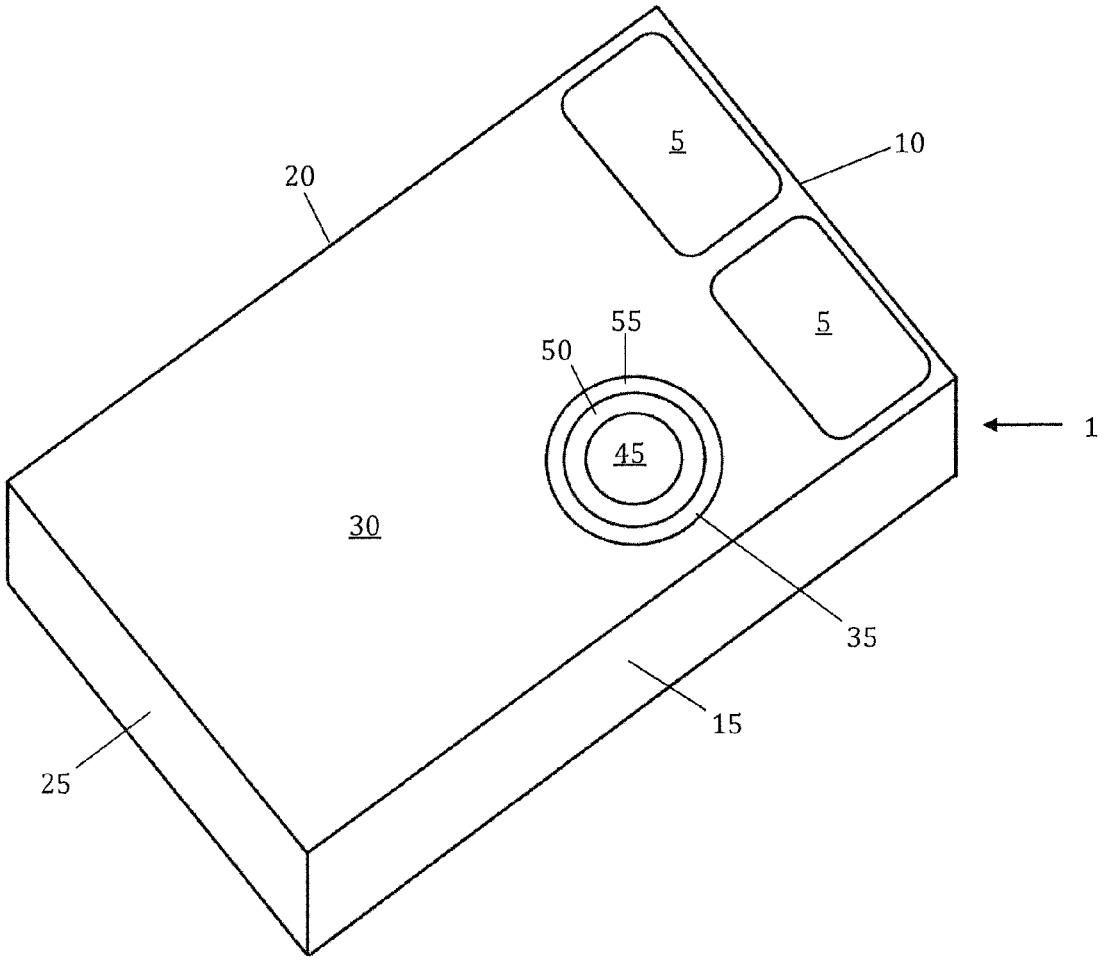
Figure 2A:
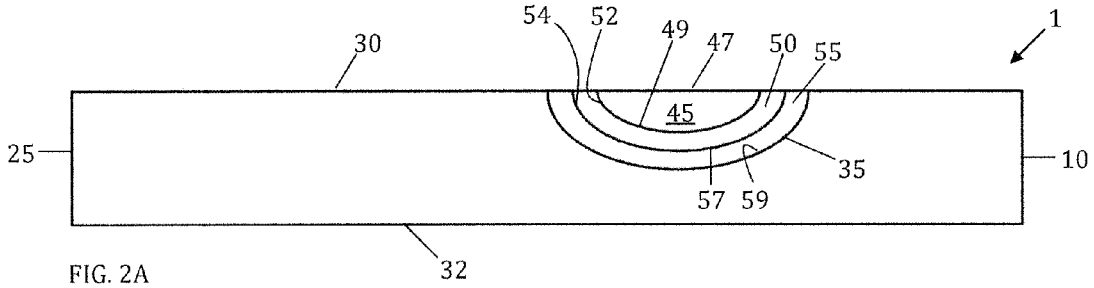
Figure 2B:
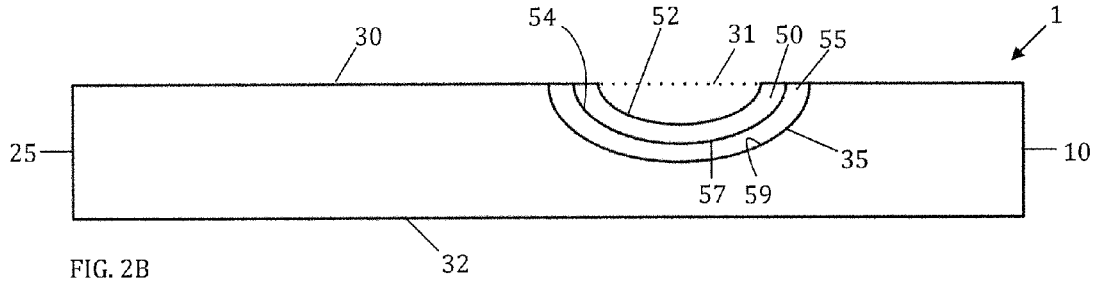
Figure 2C:
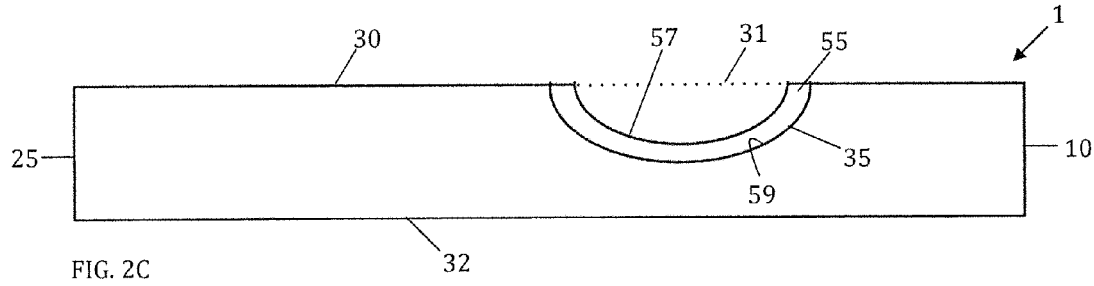
Figure 2D:
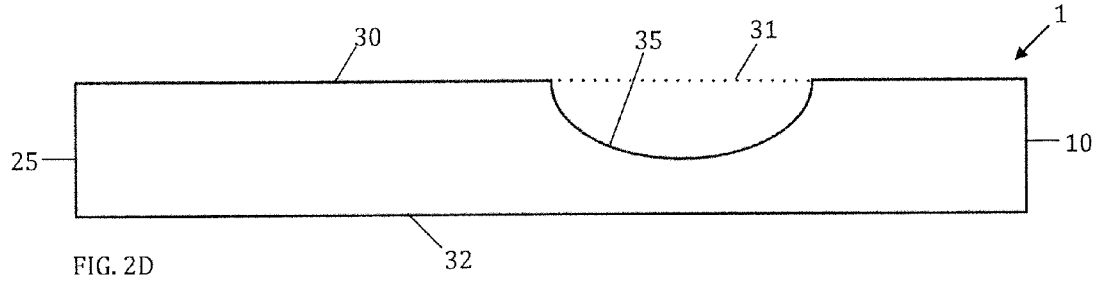
Figure 3:
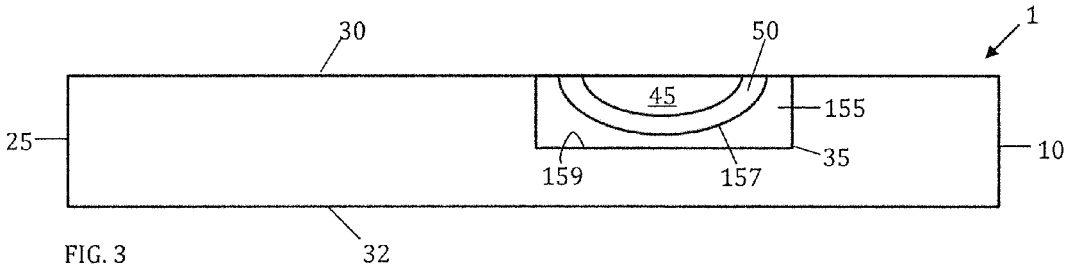
Figure 4:
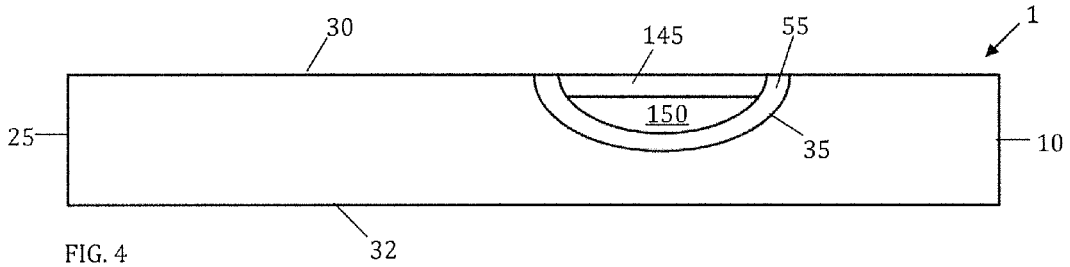
Figure 5:
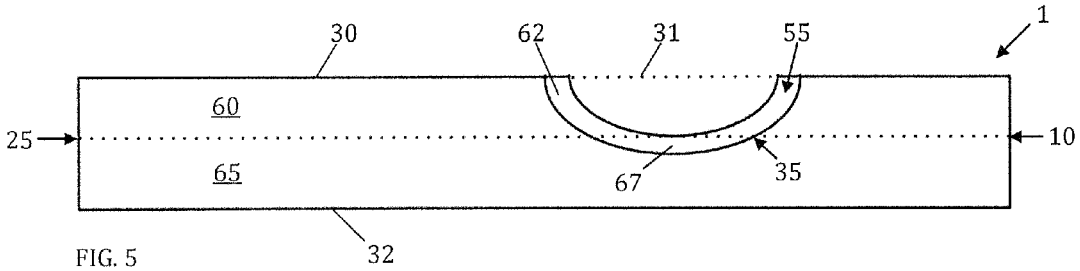
Figure 6:
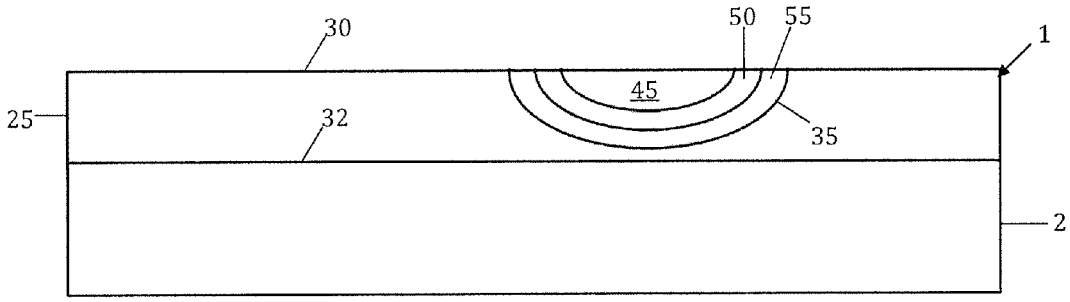
Figure 7:
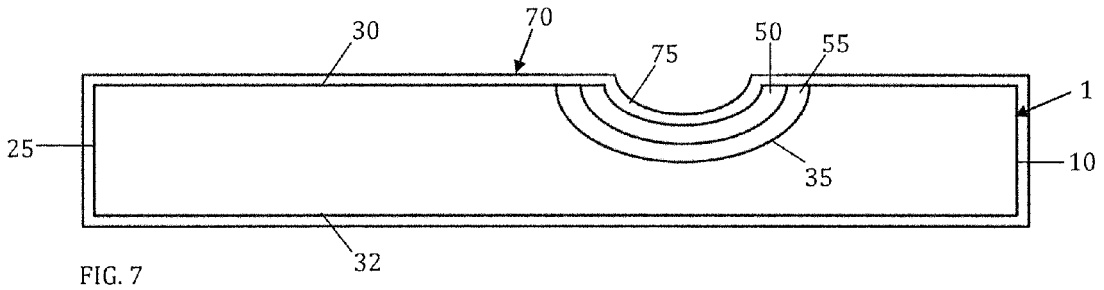
Figure 8:
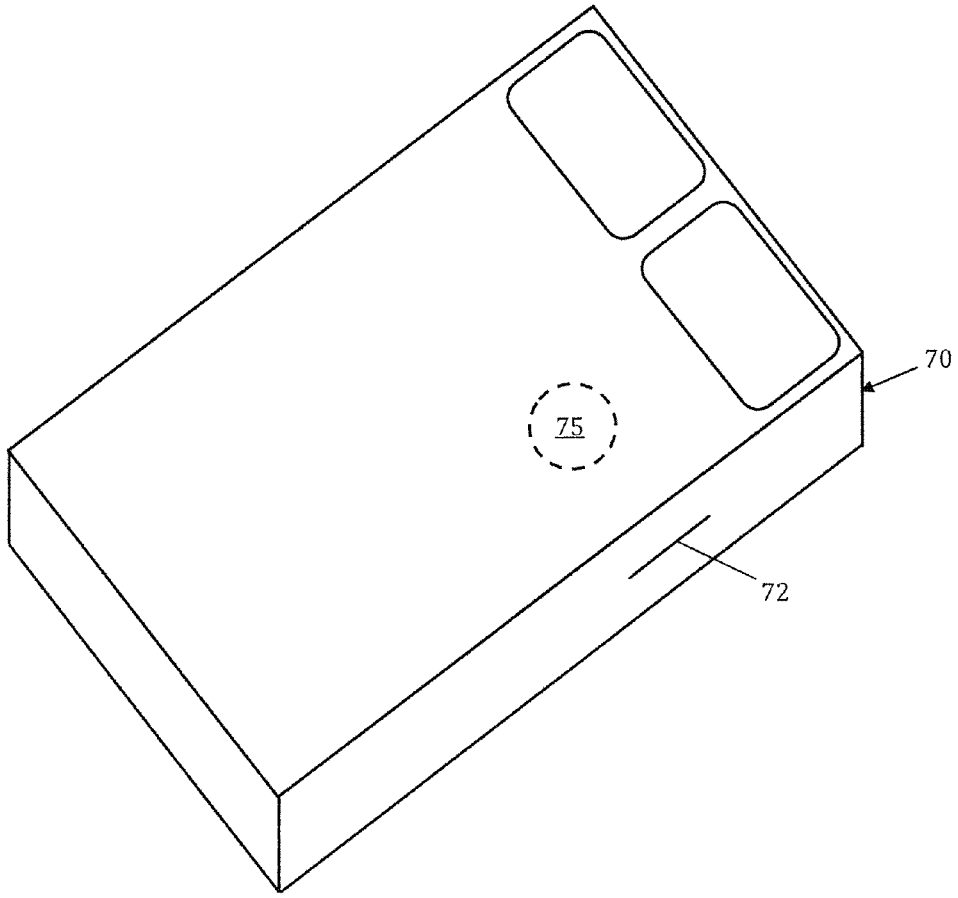
Figure 9:
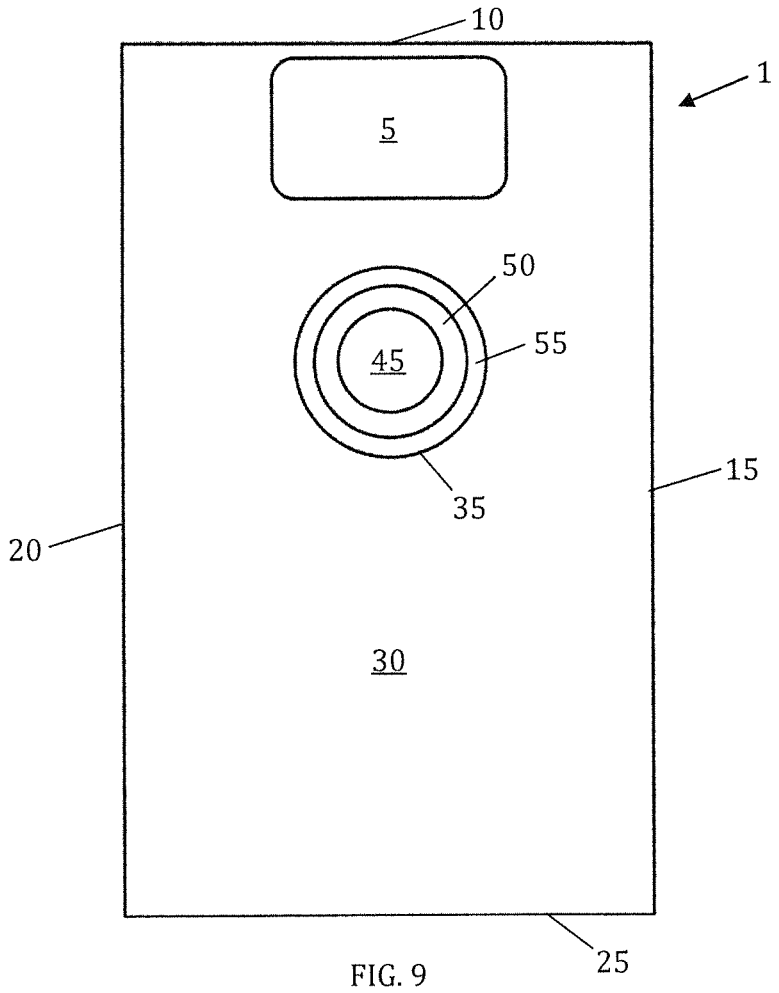
Figure 10:
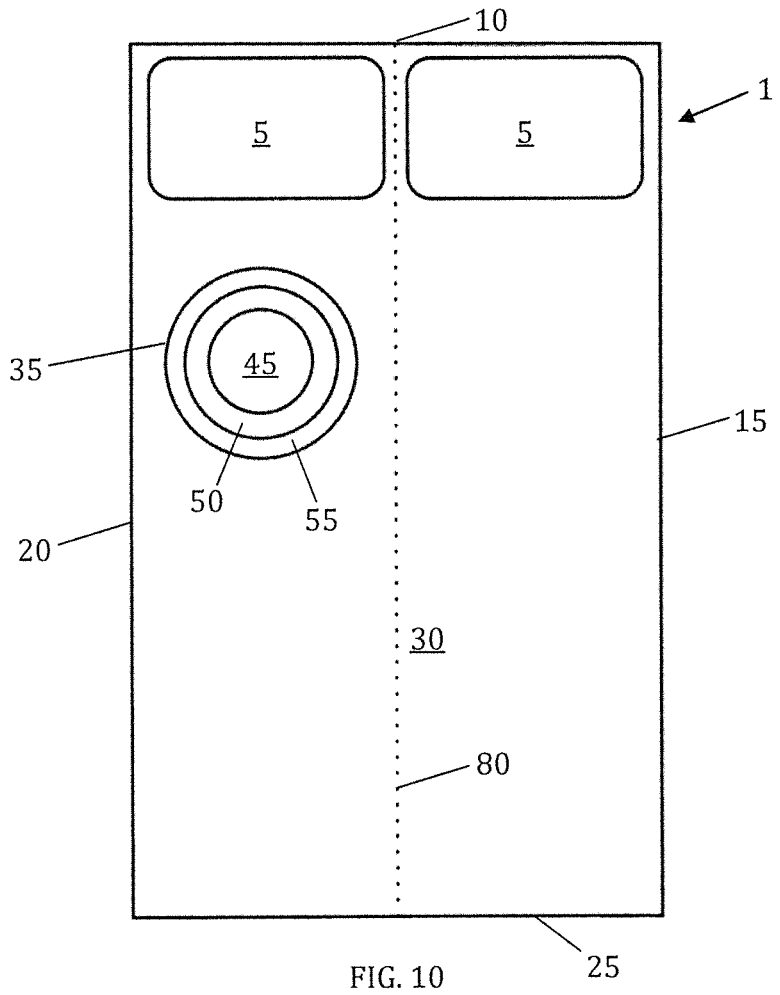
Figure 11:
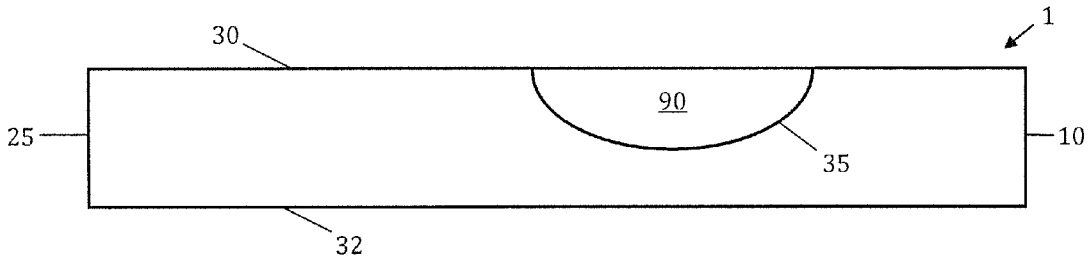
Figure 12:
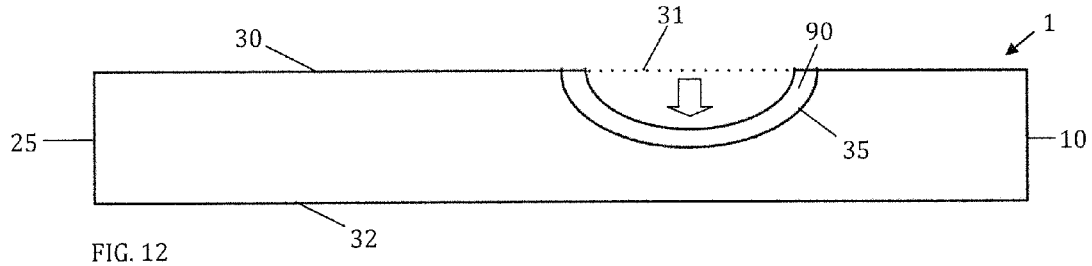

Having thus described the invention in general terms, reference will now be made to the accompanying drawings, which are not necessarily drawn to scale, and wherein:

FIG. 1 shows a perspective view of a mattress according to an embodiment of the present invention;

FIG. 2A shows a cross-sectional view of a mattress according to an embodiment of the present invention;

FIG. 2B shows a cross-sectional view of the mattress of FIG. 2A having a plug removed according to an embodiment of the present invention;

FIG. 2C shows a cross-sectional view of the mattress of FIG. 2B having an insert removed according to an embodiment of the present invention;

FIG. 2D shows a cross-sectional view of the mattress of FIG. 2C having another insert removed according to an embodiment of the present invention;

FIG. 3 shows a cross-sectional view of a mattress according to an alternative embodiment of the present invention;

FIG. 4 shows a cross-sectional view of a mattress according to another alternative embodiment of the present invention FIG. 5 shows a cross-sectional view of a mattress having multiple foam layers according to an embodiment of the present invention;

FIG. 6 shows a cross-sectional view of an embodiment of the present invention;

FIG. 7 shows a cross-sectional view of a mattress having a cover according to an embodiment of the present invention;

FIG. 8 shows a perspective view of the mattress having a cover of FIG. 6 according to an embodiment of the present invention FIG. 9 shows a top-down view of a mattress according to an embodiment of the present invention;

FIG. 10 shows a top-down view of a mattress according to an embodiment of the present invention;

FIG. 11 shows a cross-sectional view of the mattress having an adjustable insert in accordance with another embodiment of the present invention; and FIG. 12 shows a cross-sectional view of the mattress and insert of FIG. 11 having the size of the insert adjusted.

DETAILED DESCRIPTION

Some embodiments of the present invention will now be described more fully hereinafter with reference to the accompanying drawings, which are not necessarily drawn to scale and in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Some components of the mattress and associated features are not shown in one or more of the figures for clarity and to facilitate explanation of embodiments of the present invention.

As used herein, the terms "bottom," "top," "upper," "lower," "head," "foot," and similar terms are used for ease of explanation and refer generally to the position of certain components of embodiments of the described invention relative to the other components (e.g., in an operational configuration). It is understood that such terms are not used in any absolute sense, and, as such, a component described as an "upper surface" may be on the same level as (e.g., at the same distance from the ground) or below another component described as a "lower surface" or a "top surface" in certain configurations of embodiments of the described invention. For example, the "lower surface" of one insert may be disposed above the "upper surface" of another.

In some embodiments of the present invention, a mattress may include a cutout section that is configured to receive a user's stomach. The cutout may be positioned on the mattress to enable a pregnant user to lie on the mattress face-down or on her side with her stomach resting in the cutout. The mattress may further include one or more inserts disposed within the cutout to customize and control the size of a void of the cutout. In some embodiments, the inserts may define a substantially concave surface configured to receive a user's stomach. The shape of one or more of the inserts may correspond to a shape of a cutout. The inserts may be used to ensure comfort and support of the user throughout the term of her pregnancy.

FIG. 1 shows a main body 1 of a mattress having a cutout 35 in accordance with an embodiment of the present invention. Some embodiments of the main body 1 of the mattress may generally define a rectangular prism having a head surface 10 (e.g., adjacent the pillows 5), foot surface 25, first side surface 15, second side surface 20, a top surface 30, and a bottom surface 32 (shown in FIG. 2A). The mattress may include one or more inserts 50, 55, and may additionally or alternatively include a plug insert 45. As detailed herein, the one or more inserts 50, 55 may be disposed within the cutout 35 to allow the user to customize the volume of a void of the cutout. The void of the cutout 35 may be defined as the remaining volume of the cutout after the desired configuration of inserts 50, 55 have been positioned. A plug insert 45 may be used to fill the void in the cutout 35 between the one or more inserts 50, 55, such that the cutout is filled up to a plane 31 of the top surface 30. The plug insert 45 enables use of the mattress before and after a user's pregnancy. As detailed herein, the main body portion 1, inserts 50, 55, and/or plug insert 45 may be formed from a foam or other mattress material, such as by extrusion, molding, stamping, or other processes known in the art.

Referring to FIG. 2A, a cross-sectional view of a mattress showing a cutout section 35 and multiple inserts 50, 55, including a plug insert 45. The cutout 35 may be formed in the top surface 30 of the main body 1 of the mattress such that the user may lie on the top surface. The inserts 50, 55 may be disposed in the cutout 35 to ensure a supportive fit to a user's body. FIG. 2A shows an initial configuration embodiment of the main body portion 1 having a first insert 50, a second insert 50, and a plug insert 45 disposed in the cutout 35.

The first and second inserts 50, 55 may be nested on top of one another within the cutout 35 such that the volume of the void in the cutout is reduced. The first insert 50 may define an upper surface 52 and a lower surface 54, and the second insert 55 may define an upper surface 57 and a lower surface 59. In some embodiments, the upper surfaces 52, 57 of one or more of the inserts 50, 55 may define a substantially (e.g., with manufacturing tolerances) concave surface configured to receive the user's stomach. The lower surface 59 of the second insert 55 may engage the cutout 35, while the upper surface 57 of the second insert 55 may engage the lower surface 54 of the first insert 50. While reference may be made herein to two inserts, embodiments of the present invention may include any number of inserts. For example, four or five inserts may be used where more adjustment is desired in the cutout 35.

Alternatively, a single insert may be used, which may be independently adjustable (e.g., an inflatable insert). In some embodiments, for example as shown in FIG. 11, a single insert 90 may be provided that substantially fills the cutout 35. The insert 90 may be adjustable such that the size of the insert may be varied to define different void sizes within the cutout 35. In this manner, the void of the cutout 35 may be adjusted in any increment between fully filled and fully empty, such that the user may customize the fit of the mattress (e.g., by adjusting the insert 90 with a remote control). For example, the embodiment shown in FIGS. 11-12 includes an insert 90 that may be inflated and deflated, such as by remote control directing air into and out of the insert, until the desired insert size and/or void size is reached. In some other embodiments, a plug insert may be used as described above, in addition to the adjustable insert.

In some embodiments, the plug insert 45 may define a lower surface 49 configured to engage the upper surface 52 of the first insert 50. The plug insert 45 may define a substantially planar upper surface 47 such that the combination of the inserts 50, 55 and the plug insert 45 substantially fill the cutout 35. In some embodiments, the plug insert 45 may, itself, cover the entire opening of the cutout 35, while in some embodiments, as shown in FIG. 2A, the inserts 50, 55 and plug insert 45 may combine to span the opening of the cutout. The plug insert 45 may be used to allow the mattress to function as a typical mattress when the cutout 35 is not needed.

Turning to FIGS. 2B-2D, the embodiment of FIG. 2A is shown having the volume of the void in the cutout 35 progressively increased. FIG. 2B shows the embodiment of FIG. 2A having the plug insert 45 removed. FIG. 2C shows the embodiment of FIG. 2B further having the first insert 50 removed. FIG. 2D shows the embodiment of FIG. 2C having the second insert 55 removed. As detailed above, the inserts 50, 55 and/or plug insert 45 may be used to control the volume of the void in the cutout 35, such that the user may select the size of the void that matches her body. The inserts 50, 55 and/or plug insert 45 may be used to control the volume of the void from zero (e.g., a flat mattress) to a maximum size of the cutout 35. As discussed above, any number of inserts may be used depending on the desired adjustability of the mattress. In some embodiments, a maximum size of the void may be defined by the cutout 35. In some alternative embodiments, as discussed herein, one or more of the inserts may define the maximum size of the void. For example, as shown in FIG. 3, an alternate second insert 155 may include an upper surface 157 that defines a substantially concave shape configured to receive a user's stomach, while a lower surface 159 of the alternate second insert defines a generic shape of the cutout 35.

In some embodiments, the inserts may be customized to fit each user. The user may mold or shape each insert to a desired shape, such that each of the one or more inserts is configured to match a shape of the user's stomach at different stages of her pregnancy. The overall arc length, or great-circle distance, of the void defined by each insert 50, 55 may be customized by the inserts and/or cutout to suit the user's particular needs. The great-circle distance may correspond to the length of an arc across the uppermost, exposed surface within the cutout 35 (e.g., the great-circle distance may traverse portions of the inserts 50, 55 and/or cutout 35) along a direction spanning the foot surface 25 and head surface 10 of the main body portion 1. Additionally or alternatively, a shape and contour of the upper surfaces of each insert may be customized for a particular user. For example, some users may use a narrower but deeper insert, while others use a longer but shallower insert at the same stage of pregnancy. Further, in this embodiment, a shape of the lower surface of the plug insert may be an inverse shape of the upper surface of the first insert. In some other embodiments, the inserts may be a standard shape designed to fit any user.

Each insert 50, 55 and/or the cutout 35 may be sized to match the size of the user's stomach at various stages of pregnancy. For example, in some embodiments, the first insert 50 may be sized to match a user's stomach during the first trimester, the second insert 55 may be sized to match a user's stomach during the second trimester, and the cutout 35 may be sized to match a user's stomach during the third trimester. In particular, some embodiments of the present invention may scale the size of the inserts relative to the fundal height of the user. Fundal height is a measurement of the size of the user's uterus from the pubic bone to the top of the uterus. The inserts may control the volume of the void to define a great-circle distance that is approximately equal to the user's fundal height at predetermined intervals of the pregnancy. As detailed herein, the great-circle distance of a given insert 50, 55 may correspond to a distance along the arc of uppermost surface inside the cutout 35, which defines the void. For example, in FIG. 2C the great-circle distance of the second insert 55 corresponds to the distance along the arc defined by the cross-section of the second insert between each point where the insert intersects the plane 31 of the top surface 30. Said differently, the great-circle distance may correspond to the longest arc that may be drawn across the combined surfaces (e.g., the inserts 50, 55 and/or the cutout 35 itself) from one edge of the void to the other, below the plane 31 of the top surface 30. Additionally or alternatively, the great-circle distance may be defined within a plane that is parallel to the planes of the first side surface 15 and second side surface 20.

The great-circle distances of each insert 50, 55 and the cutout 35 may correspond to progressively increasing fundal heights during the course of the pregnancy. For example, a first insert 50 corresponding to a first trimester of pregnancy may define a great-distance of 5-10 centimeters (1.96-3.93 inches). Similarly, a second insert corresponding to a second trimester of pregnancy may define a great-circle distance of 26-30 centimeters (10.24-11.81 inches). And a cutout 35 or, alternatively, third insert corresponding to a third trimester of pregnancy may define a great-circle distance of 30-34 centimeters (11.81-13.39 inches). As detailed herein, the great-circle distances and shape of the curvature may be customized based on a user's specific pregnancy. For example, based on the user's fundal height during the first trimester, second and third trimester inserts may be manufactured matching the user's predicted size. In this manner, the mattress may provide support to the user during all stages of pregnancy. Also as noted above, more or less than two inserts may be used, in each case with each insert defining successively sized great-circle distances.

In some embodiments, for example, as shown in FIG. 2A, the inserts 50, 55 may independently define the void by being positioned adjacent the plane 31 of the top surface 30 around their circumferences. In some embodiments, the inserts may be different shapes and/or may not reach the plane 31 of the top surface 30 of the main body portion 1. For example, turning to FIG. 4, some embodiments of the present invention may include an alternate first insert 150 defining a substantially different shape than a second insert 55. In some other embodiments, for example as shown in FIGS. 2A-2C, the inserts 50, 55 may be substantially concentric. A plug insert 45, 145 may be configured to fill the void of the cutout 35 regardless of the shapes of the inserts 50, 150, 55, 155.

Some embodiments of the cutout 35 and inserts 45, 50, 55 (e.g., as shown in FIG. 1) may be substantially circular in shape with respect to the plane 31 of the top surface 30 of the main body portion 1. In some alternative embodiments, the cutout 35, inserts 50, 55, and/or plug insert 45 may be a substantially oval shape relative to the plane 31 of the top surface 30 of the main body portion 1. In yet another embodiment, as discussed herein, the cutout 35, inserts 50, 55, and/or plug insert 45 may be customized to the user's body, such that the void of the cutout matches the shape of a user's stomach.

Turning to FIG. 5, the main body portion 1 of the mattress may be formed of multiple foam layers, depending on the needs of the user and the manufacturer. For example, as shown in FIG. 5, the main body portion 1 may be made of a first, upper layer 60 and a second, lower layer 65. The layers 60, 65 may be parallel sections of foam or other mattress material that collectively define the main body portion 1. In the embodiment shown in FIG. 5, an upper surface of the first layer 60 defines the top surface 30 of the main body portion 1, and a lower surface of the second layer 65 defines the bottom surface 32 of the main body portion. In some embodiments, the first 60 and second 65 layers may have different densities, and in some further embodiments, the first layer may be less dense than the second layer.

In some alternative embodiments, additional layers may be included between the first and second layers. In yet another embodiment, the main body portion may be a single, uniform layer.

Referring to FIG. 5, the cutout 35 may be formed in more than one layer 60, 65 of the main body portion 1. The inserts 50, 55 and/or plug insert 45 (shown in FIG. 2A) may be formed from the same material as the first 60 and second 65 layers. In some embodiments, the inserts 50, 55 and/or plug insert 45 may be formed simultaneously with forming the main body portion 1 of the mattress, such that the inserts and/or plug insert may have substantially the same composition as the main body portion of the mattress. For example, with reference to FIG. 5, the second insert 55 may span the two layers 60, 65 such that an upper portion 62 of the second insert is composed of substantially the same material as the first layer. Similarly a lower portion 67 of the second insert 55 may be composed of substantially the same material as the second layer 65. Alternatively, the cutout 35 may be defined in the first layer 60 alone. In some alternative embodiments, the inserts 50, 55 and/or plug insert 45 may formed separately. The inserts 50, 55 and/or plug insert 45 may additionally, or alternatively be formed from one or more different materials from the main body portion 1.

With reference to FIG. 6, in any of the embodiments described herein, the main body portion 1 of the mattress may be a mattress-topper that may be positioned atop a lower mattress 2. In this embodiment, the lower mattress 2 may be any typical mattress, such that the main body portion 1 may be added during pregnancy and later removed without replacing the entire mattress.

Referring to FIGS. 7-8, a cover 70 may be used to retain the inserts 50, 55 and/or plug insert 45 within the cutout 35. As shown in FIG. 7, the cover 70 may include a deformable portion 75 configured to match the contour of the inserts 50, 55 and/or plug insert 45. The deformable portion 75 may naturally rest against the uppermost of the inserts 50, 55 and/or plug insert 45 or may be configured to attach to the uppermost inserts 50, 55 and/or plug insert 45. In some embodiments, the deformable portion 75 may be flexible and/or elastic such that when the mattress is unoccupied, the deformable portion 75 of the cover 70 is substantially coplanar with the plane 31 of the top surface 30, and when a user lies on the mattress, the deformable portion 75 may deflect into the cutout until it contacts the uppermost of the inserts 50, 55.

As inserts 50, 55 and/or the plug insert 45 may be added or removed, the deformable portion 75 may retain the remaining inserts 50, 55 and/or plug insert 45 within the cutout 35 while not substantially altering the volume of the void (e.g., beyond the added thickness of the cover) in the cutout when the mattress is in use. Comparing FIGS. 2A-2D with FIG. 7, the deformable portion 75 of the cover 70 may be configured to match the contour of the void, as may be defined by the uppermost surfaces of whichever inserts 50, 55 or plug insert 45 are disposed within the cutout 35. In this manner, the deformable portion 75 may be configured to be substantially coplanar with the plane 31 of the top surface when all of the inserts 50, 55 and the plug insert 45 are disposed within the cutout 35. Similarly, when at least the plug insert 45 is removed, the deformable portion 75 may match the contour of the upper surface 52, 57 of the remaining insert or inserts 50, 55.

Referring to FIG. 8, the cover 70 may include an access opening 72 which may be closed with a closure device, such as a zipper, button, snap, or the like.

Comparing FIGS. 6 and 7, in some embodiments where the main body portion 1 is a mattress topper, the cover 70 may be configured to surround both the main body portion 1 and the lower mattress 2. Alternatively, the cover 70 may only surround the main body portion 1.

Turning to FIGS. 9 and 10, the cutout 35 may be disposed in various locations along the top surface 30 of the main body portion 1. For example, as shown in FIG. 9, the cutout 35 may be disposed approximately in the center of the mattress relative to the first side surface 15 and the second side surface 20.

Alternatively, the main body portion 1 may be configured to accommodate more than one user. With reference to FIG. 10, the cutout 35 may be disposed between a centerline 80 of the mattress and either of the first side surface 15 and the second side surface 20.

Further, referring to FIGS. 9 and 10, the cutout 35 may be disposed closer to the head surface 10 of the main body portion than the foot surface 25. In some embodiments, the cutout 35 may be positioned at a location corresponding to where a user's stomach would rest when her head lies on the pillows 5 near the head surface 10.

In addition, many other modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. By way of example, any features of any embodiment described herein may be wholly or partially incorporated or combined into various other embodiments. Although specific terms are employed herein, they are used in a generic and descriptive sense only and not for purposes of limitation. Moreover, steps in the methods described above may occur in any order and are not limited to the order described above.

What is claimed is:

1. A mattress for use during pregnancy, the mattress comprising:

a main body portion comprising:

a top surface, a bottom surface, a first side surface, a second side surface, a foot surface, a head surface, and a cutout formed in the top surface;

at least one insert configured to be disposed in the cutout of the main body portion, wherein the at least one insert defines a substantially concave surface configured to receive a user's stomach, and wherein the at least one insert comprises an inflatable insert, which inflatable insert is configured to inflate and deflate to change in size, wherein the at least one insert comprises a first insert and a second insert;

wherein the first insert defines a first upper surface and a first lower surface and the second insert defines a second upper surface and a second lower surface;

wherein the second insert is configured to receive the first insert therein and the first lower surface is configured to be disposed adjacent the second upper surface;

wherein the second insert is configured to be received by the cutout of the main body portion and the second lower surface is configured to engage the cutout; and wherein the first upper surface and a plane of the top surface of the main body portion are configured to define a first volume and the second upper surface and the plane of the top surface of the main body portion are configured to define a second volume, such that the second volume is greater than the first volume; and wherein the mattress further comprises:

a plug insert having an upper surface and a lower surface;

wherein the lower surface of the plug insert is configured to engage the first upper surface, wherein the upper surface of the plug insert is substantially planar, such that the upper surface of the plug insert is substantially flush with the lane of the to surface of the main body portion:

wherein the second insert abuts the plane of the top surface, wherein the first insert is disposed entirely below the plane of the top surface, and wherein the plug insert is configured to engage the second upper surface of the second insert.

2. The mattress of claim 1, further comprising a cover surrounding the main body portion, wherein the cover is configured to maintain the at least one insert in the cutout, and wherein the cover comprises an access opening configured to allow the user to access the at least one insert.

3. The mattress of claim 2, wherein the cover is configured to deform along a portion of the cover aligned with the cutout.

4. The mattress of claim 1, wherein the main body portion of the mattress comprises at least a first layer and a second layer;

wherein the first layer of the main body portion is configured to define the top surface of the main body portion;

wherein a first portion of the cutout is defined in the first layer and a second portion of the cutout is defined in the second layer;

wherein the at least one insert comprises a first insert and a second insert;

wherein when the first and second inserts are engaged with the cutout, the second insert engages the first and second layers and the first insert engages the first layer and the second insert.

5. The mattress of claim 4, wherein the second layer of the main body portion is configured to define the bottom surface of the main body portion.

6. The mattress of claim 1, wherein the at least one insert is configured to be replaced with at least one replacement insert; wherein the at least one replacement insert defines a replacement concave surface; and wherein the replacement concave surface has a curvature that is different than the concave surface of the at least one insert.

7. The mattress of claim 1, wherein the cutout is defined in the top surface between the first side surface and a centerline extending between the foot surface and the head surface.

8. The mattress of claim 1, wherein the at least one insert comprises a first insert and a second insert; and wherein the first insert defines a great-circle distance between 1.96 and 3.93 inches.

9. The mattress of claim 1, wherein the at least one insert comprises a second insert; and wherein the second insert defines a great-circle distance between 10.24 and 11.81 inches.

10. The mattress of claim 1, wherein the at least one insert is configured to be removable, such that the cutout defines a great-circle distance between 11.81 and 13.39 inches.

11. The mattress of claim 1, wherein the first upper surface of the first insert is substantially planar, and wherein the second upper surface of the second insert is concave.

12. The mattress of claim 1, wherein the second lower surface of the second insert defines at least one perpendicular angle, and wherein the second upper surface is concave.

13. A method of manufacturing a mattress for use during pregnancy, the method comprising:

forming a main body portion comprising:

a top surface, a bottom surface, a first side surface, a second side surface, a foot surface, and a head surface;

forming a cutout in the top surface of the main body portion; and forming at least one insert;

wherein the at least one insert is configured to be disposed in the cutout of the main body portion, wherein the at least one insert defines a substantially concave surface configured to receive a user's stomach, wherein the at least one insert comprises an inflatable insert, which inflatable insert is configured to inflate and deflate to change in size, wherein the at least one insert comprises a first insert and a second insert;

wherein the first insert defines a first upper surface and a first lower surface and the second insert defines a second upper surface and a second lower surface;

wherein the second insert is configured to receive the first insert therein and the first lower surface is configured to be disposed adjacent the second upper surface;

wherein the second insert is configured to be received by the cutout of the main body portion and the second lower surface is configured to engage the cutout; and wherein the first upper surface and a plane of the top surface of the main body portion are configured to define a first volume and the second upper surface and the plane of the top surface of the main body portion are configured to define a second volume, such that the second volume is greater than the first volume; and wherein the mattress further comprises:

a plug insert having an upper surface and a lower surface;

wherein the lower surface of the plug insert is configured to engage the first upper surface, and wherein the upper surface of the plug insert is substantially planar, such that the upper surface of the plug insert is substantially flush with the lane of the to surface of the main body portion;

wherein the second insert abuts the plane of the top surface, wherein the first insert is disposed entirely below the plane of the top surface, and wherein the plug insert is configured to engage the second upper surface of the second insert.

14. The method of claim 13, wherein forming the at least one insert comprises cutting material from the cutout of the main body portion substantially simultaneously with forming the cutout.

15. The method of claim 13, wherein forming the main body portion comprises disposing at least a first layer on top of a second layer, such that an upper surface of the first layer defines the top surface of the main body portion;

wherein forming a cutout comprises forming a first portion of the cutout in the first layer and forming a second portion of the cutout in the second layer;

wherein forming the at least one insert comprises forming a first insert from the first layer and forming a second insert by cutting through the first and second layers.

16. A mattress for use during pregnancy, the mattress comprising:

a main body portion comprising:

a top surface, a bottom surface, a first side surface, a second side surface, a foot surface, a head surface, and a cutout formed in the top surface;

at least one insert configured to be disposed in the cutout of the main body portion, wherein the at least one insert defines a substantially concave surface configured to receive a user's stomach, wherein the at least one insert comprises a first insert and a second insert;

wherein the first insert defines a first upper surface and a first lower surface and the second insert defines a second upper surface and a second lower surface;

wherein the second insert is configured to receive the first insert therein and the first lower surface is configured to be disposed adjacent the second upper surface;

wherein the second insert is configured to be received by the cutout of the main body portion and the second lower surface is configured to engage the cutout; and wherein the first upper surface and a plane of the top surface of the main body portion are configured to define a first volume and the second upper surface and the plane of the top surface of the main body portion are configured to define a second volume, such that the second volume is greater than the first volume; and a plug insert having an upper surface and a lower surface;

wherein the lower surface of the plug insert is configured to engage the first upper surface, and wherein the upper surface of the plug insert is substantially planar, such that the upper surface of the plug insert is substantially flush with the plane of the top surface of the main body portion;

wherein the second insert abuts the plane of the top surface, wherein the first insert is disposed entirely below the plane of the top surface, and wherein the plug insert is configured to engage the second upper surface of the second insert.

* * * * *